US011700980B2

(12) United States Patent
Tsuchida et al.

(10) Patent No.: US 11,700,980 B2
(45) Date of Patent: Jul. 18, 2023

(54) ELECTRIC BLOWER, VACUUM CLEANER, AND HAND DRYING DEVICE

(71) Applicant: Mitsubishi Electric Corporation, Tokyo (JP)

(72) Inventors: Kazuchika Tsuchida, Tokyo (JP); Naho Adachi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 197 days.

(21) Appl. No.: 16/486,891

(22) PCT Filed: Apr. 19, 2017

(86) PCT No.: PCT/JP2017/015655
§ 371 (c)(1),
(2) Date: Aug. 19, 2019

(87) PCT Pub. No.: WO2018/193530
PCT Pub. Date: Oct. 25, 2018

(65) Prior Publication Data

US 2020/0229660 A1 Jul. 23, 2020

(51) Int. Cl.
*A47K 10/48* (2006.01)
*A47L 5/22* (2006.01)
(Continued)

(52) U.S. Cl.
CPC ..... *A47K 10/48* (2013.01); *A47L 5/22* (2013.01); *F04D 25/08* (2013.01); *F04D 29/056* (2013.01);
(Continued)

(58) Field of Classification Search
CPC ..... A47K 10/48; A47L 5/22; F04D 29/056; F04D 29/281; F04D 29/444; F04D 29/5806; F04D 29/051; F04D 17/162; F04D 2250/52; F04D 25/082; F04D 17/105; F04D 25/16; H02K 9/06
(Continued)

(56) References Cited

U.S. PATENT DOCUMENTS 2,710,573 A 6/1955 Marker
2,814,432 A * 11/1957 Eiserman ..... F04D 17/162 417/353
(Continued)

FOREIGN PATENT DOCUMENTS

CN 1094746 C * 11/2002
EP 0411134 A1 2/1991
(Continued)

OTHER PUBLICATIONS

Centrifugal Pump Diffuser; https://www.engineersedge.com/pumps/diffuser.htm (Year: 2015).*
(Continued)

*Primary Examiner* — Devon C Kramer
*Assistant Examiner* — Joseph S. Herrmann
(74) *Attorney, Agent, or Firm* — Posz Law Group, PLC

(57) ABSTRACT

An electric blower includes a motor, a first rotor blade provided on one end side of the motor in an axial direction, a second rotor blade provided on another side of the motor opposite to the first rotor blade in the axial direction, and a first stator blade provided to face the first rotor blade.

15 Claims, 8 Drawing Sheets

(51) Int. Cl.

| | |
|---|---|
| *F04D 25/08* | (2006.01) |
| *F04D 29/056* | (2006.01) |
| *F04D 29/28* | (2006.01) |
| *F04D 29/44* | (2006.01) |
| *F04D 29/58* | (2006.01) |

(52) U.S. Cl.
CPC ..... *F04D 29/281* (2013.01); *F04D 29/444* (2013.01); *F04D 29/5806* (2013.01)

(58) Field of Classification Search
USPC ..... 417/350, 369, 423.5; 310/63
See application file for complete search history.

(56) References Cited

U.S. PATENT DOCUMENTS

| | | | | | |
|---|---|---|---|---|---|
| 3,145,641 | A * | 8/1964 | Maynard | F24F 9/00 454/192 |
| 5,811,899 | A * | 9/1998 | Warner | F04D 25/082 310/90 |
| 2009/0136341 | A1 | 5/2009 | Kenyon | |
| 2010/0189554 | A1 | 7/2010 | Grasmuck | |
| 2012/0275915 | A1* | 11/2012 | Konishi | F04D 29/162 415/206 |
| 2013/0223997 | A1 | 8/2013 | Childe et al. | |
| 2015/0247506 | A1 | 9/2015 | Lee | |
| 2016/0007813 | A1* | 1/2016 | Ros Mar N | A47K 10/48 34/569 |
| 2016/0032938 | A1* | 2/2016 | Hayamitsu | F04D 29/30 415/206 |
| 2016/0177961 | A1 | 6/2016 | Ogata et al. | |
| 2019/0081519 | A1 | 3/2019 | Baba et al. | |
| 2019/0081520 | A1 | 3/2019 | Baba et al. | |
| 2019/0081521 | A1 | 3/2019 | Baba et al. | |

FOREIGN PATENT DOCUMENTS

| | | | | | |
|---|---|---|---|---|---|
| JP | 09100800 | A | * | 4/1997 | |
| JP | H09-100800 | A | | 4/1997 | |
| JP | H10-026099 | A | | 1/1998 | |
| JP | 2008-190328 | A | | 8/2008 | |
| JP | 2008190328 | A | * | 8/2008 | |
| JP | 2011019860 | A | * | 2/2011 | |
| JP | 2011-080409 | A | | 4/2011 | |
| JP | 2011080409 | A | * | 4/2011 | |
| JP | 2012-102641 | A | | 5/2012 | |
| JP | 2013-044435 | A | | 3/2013 | |
| JP | 2014-051989 | A | | 3/2014 | |
| JP | 2016-118194 | A | | 6/2016 | |
| KR | 101372320 | B1 | | 3/2014 | |
| WO | 2011/154092 | A1 | | 12/2011 | |
| WO | 2012132199 | A1 | | 10/2012 | |
| WO | 2016/017877 | A1 | | 2/2016 | |
| WO | 2017/208290 | A1 | | 12/2017 | |
| WO | 2017/208291 | A1 | | 12/2017 | |
| WO | 2017/208293 | A1 | | 12/2017 | |
| WO | WO-2018011917 | A1 | * | 1/2018 | B25F 5/008 |
| WO | WO-2018083783 | A1 | * | 5/2018 | F04D 29/44 |

OTHER PUBLICATIONS

CN-1094746-C (same document as the corresponding foreign patent document) (Year: 2002).*

Japanese Office Action dated Jul. 14, 2020 issued in the corresponding JP application No. 2019-513122( English translation attached).

Japanese Office Action dated Apr. 28, 2020 issued in the corresponding JP application No. 2019-513122( English translation attached).

European Search Report dated Jun. 22, 2021, issued in corresponding European Patent Application No. 21167684.6.

International Search Report of the International Searching Authority dated Jun. 13, 2017 for the corresponding international application No. PCT/JP2017/015655 (and English translation).

Extended European Search Report dated Mar. 6, 2020 issued in the corresponding EP application No. 17906708.7.

Office Action dated Apr. 25, 2023 in connection with counterpart European Patent Application No. 21167684.6.

* cited by examiner

ELECTRIC BLOWER, VACUUM CLEANER, AND HAND DRYING DEVICE

CROSS REFERENCE TO RELATED APPLICATION

This application is a U.S. national stage application of International Patent Application No. PCT/JP2017/015655 filed on Apr. 19, 2017, the disclosure of which is incorporated herein by reference.

TECHNICAL FIELD

The present invention relates to an electric blower including a motor.

BACKGROUND

An electric blower formed of a casing, a motor disposed inside the casing, and a blade part (e.g., rotor blade) fixed to a shaft of the motor is generally used. In this type of electric blower, when the motor and the blade part are rotating, air flows into the casing through an intake formed in the casing and the air is discharged outside the casing through an outlet formed in the casing (see Patent Reference 1, for example).

PATENT REFERENCE

Patent Reference 1: Japanese Patent Application Publication No. 2013-44435

However, when air flows into the electric blower through the intake while the motor is driving, thrust force occurs in the shaft of the motor and the blade part due to pressure difference between the intake side and the outlet side. Due to the thrust force, a thrust load occurs in the motor. For example, in a case where the shaft is supported by a bearing, friction occurs between an inner ring and an outer ring of the bearing. As a result, a problem arises in that the operating life of the bearing decreases and the operating life of the electric blower decreases.

SUMMARY

An object of the present invention is to reduce the thrust load acting on the motor when the rotor blade rotates and prevent the decrease in the operating life of the electric blower.

An electric blower according to the present invention includes a motor, a first rotor blade provided on one end side of the motor in an axial direction, a second rotor blade provided on another side of the motor opposite to the first rotor blade in the axial direction, a first stator blade provided to face the first rotor blade, and a second stator blade provided to face the second rotor blade.

According to the present invention, the thrust load acting on the motor can be reduced and the decrease in the operating life of the electric blower can be prevented.

DETAILED DESCRIPTION

First Embodiment

Figure 1:
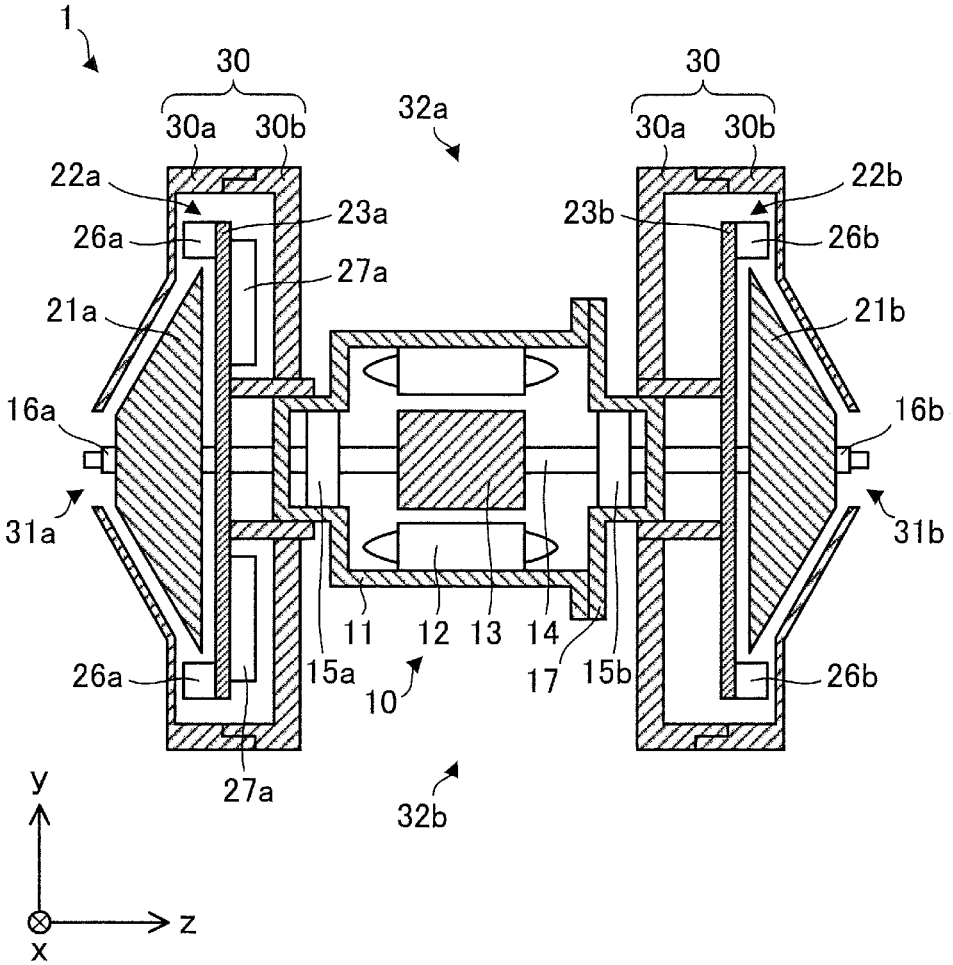
FIG. 1 is a cross-sectional view schematically showing a structure of an electric blower according to a first embodiment of the present invention.
Figure 2A:
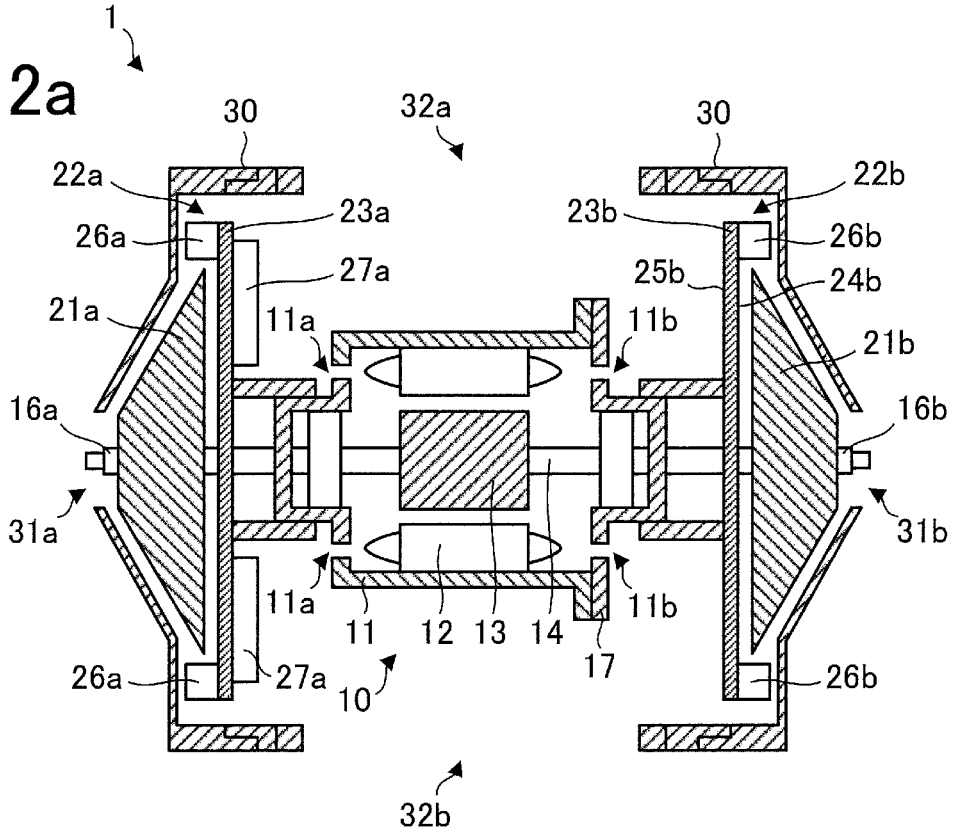
FIG. 2*a* is a cross-sectional view schematically showing the structure of the electric blower.
Figure 2B:
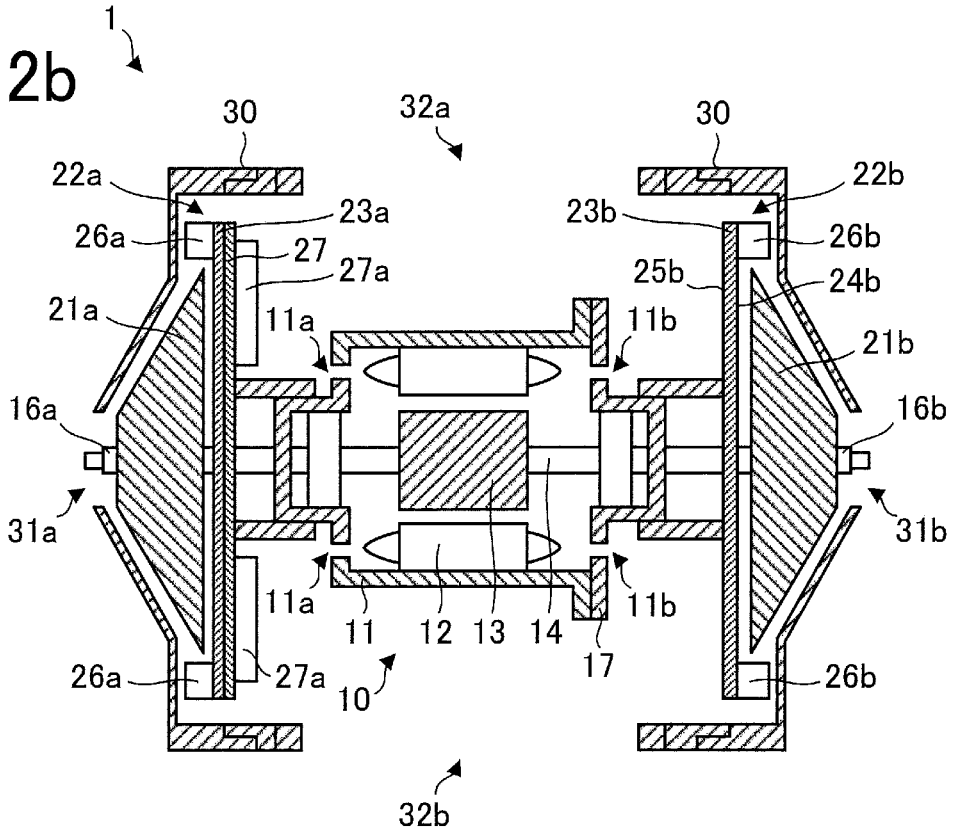
FIG. 2*b* is a cross-sectional view schematically showing another structure of the electric blower shown in FIG. 1 and FIG. 2*a*.

FIG. 1 and FIG. 2*a* are cross-sectional views schematically showing a structure of an electric blower 1 according to a first embodiment of the present invention. Specifically, FIG. 2*a* is a diagram showing a state in which the electric blower 1 shown in FIG. 1 is rotated in a circumferential direction. The "circumferential direction" is the direction of rotation of a rotor blade 21*a*, for example. FIG. 2*b* is a diagram showing another example of the electric blower 1 shown in FIG. 1 and FIG. 2*a*. The cross section position of the electric blower 1 in FIG. 2*b* is the same as the cross section position of the electric blower 1 in FIG. 2*a*.

In the xyz orthogonal coordinate system shown in FIG. 1, a z-axis direction (z-axis) represents a direction parallel to an axis line of a shaft 14 of a motor 10 (rotation center of a rotor 13) (hereinafter referred to as an "axial direction"), an x-axis direction (x-axis) represents a direction orthogonal to the z-axis direction (z-axis), and a y-axis direction represents a direction orthogonal to both of the z-axis direction and the x-axis direction.

The electric blower 1 includes the motor 10, the rotor blade 21*a* (first rotor blade), a rotor blade 21*b* (second rotor blade), a stator blade 22*a* (first stator blade), a stator blade 22*b* (second stator blade), and a casing 30.

The motor 10 is a permanent magnet synchronous motor, for example. However, it is also possible to use a motor other than a permanent magnet synchronous motor, such as a commutator motor, as the motor 10. The permanent magnet synchronous motor means a synchronous motor including a permanent magnet (ferromagnetic body) and using the permanent magnet (ferromagnetic body) for generating a magnetic field.

The motor 10 includes a motor frame 11 (also referred to simply as a "frame"), a stator 12 fixed to the motor frame 11, the rotor 13 disposed inside the stator 12, the shaft 14 fixed to the rotor 13, bearings 15*a* and 15*b* supporting the shaft 14, nuts 16*a* and 16*b*, and a bracket 17 that is a part of the motor frame 11. The shaft 14 is press-fitted in the bearings 15*a* and 15*b*.

The bearing 15*a* (specifically, an outer circumferential surface of the bearing 15*a*) is fixed to an inner circumferential surface of the motor frame 11. The bearing 15*b* (specifically, an outer circumferential surface of the bearing 15*b*) is fixed to an inner circumferential surface of the bracket 17.

The motor frame 11 covers the stator 12 and the rotor 13. The motor frame 11 has holes (windholes) 11*a* and 11*b* (FIG. 2*a*). In this embodiment, a plurality of holes 11*a* and a plurality of holes 11*b* are formed respectively on both sides of the motor frame 11 in the axial direction. Specifically, the holes 11*b* are formed in the bracket 17 that is a part of the motor frame 11. Each hole 11*a*, 11*b* passes through the motor frame 11 in the axial direction.

The casing 30 covers the rotor blades 21*a* and 21*b* and the stator blades 22*a* and 22*b*. The casing 30 includes fan covers 30*a* each covering the rotor blade (rotor blade 21*a* or 21*b*), fan cover support parts 30*b* supporting the fan covers 30*a*, an intake 31*a* (first intake), an intake 31*b* (second intake), an outlet 32*a* (first outlet), and an outlet 32*b* (second outlet).

The fan cover 30*a* is inserted in the fan cover support part 30*b*, and the fan cover support part 30*b* is fixed to the motor frame 11 or the bracket 17.

The intake 31*a* is formed in the casing 30 to face the rotor blade 21*a*, while the intake 31*b* is formed in the casing 30 to face the rotor blade 21*b*.

The outlets 32*a* and 32*b* are formed in the casing 30 to face the motor 10.

Figure 3A:
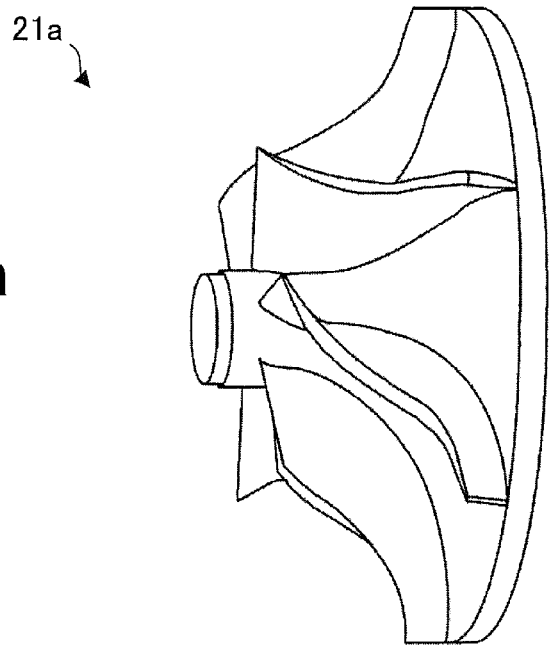
FIG. 3*a* is a perspective view schematically showing a structure of a mixed flow fan as a rotor blade.
Figure 3B:
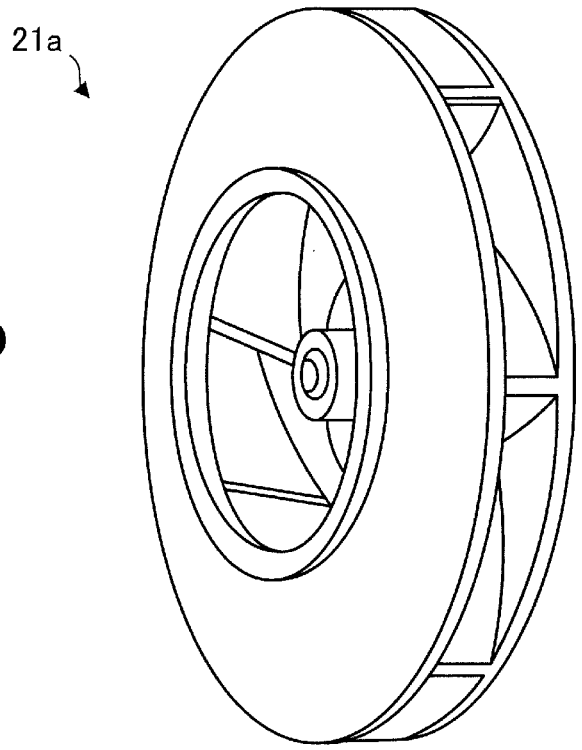
FIG. 3*b* is a perspective view schematically showing a structure of a turbo fan as the rotor blade.

FIGS. 3*a* and 3*b* are perspective views showing examples of the rotor blade 21*a*. The rotor blades shown in FIGS. 3*a* and 3*b* are usable also as the rotor blade 21*b*.

FIG. 3*a* is a perspective view schematically showing a structure of a mixed flow fan as a centrifugal fan used as the rotor blade. The mixed flow fan is a fan that generates an air current in a direction inclined with respect to the rotation axis of the rotor blade. FIG. 3*b* is a perspective view schematically showing a structure of a turbo fan as a centrifugal fan used as the rotor blade. The turbo fan is a fan having vanes formed backward. However, the rotor blades 21*a* and 21*b* may be fans other than mixed flow fans or turbo fans.

The rotor blades 21*a* and 21*b* are desired to be rotor blades (e.g., mixed flow fans or turbo fans) having the same structure as each other so that the thrust loads acting on the rotor blades 21*a* and 21*b* are equal to each other.

The rotor blade 21*a* is provided on one end side of the motor 10 in the axial direction, while the rotor blade 21*b* is provided on another side opposite to the rotor blade 21*a* in the axial direction. The rotor blades 21*a* and 21*b* are respectively fixed to the shaft 14 by the nuts 16*a* and 16*b*, and the shaft 14 rotates the rotor blades 21*a* and 21*b*. Specifically, the rotor blades 21*a* and 21*b* rotate in accordance with the rotation of the motor 10 (specifically, the rotor 13 and the shaft 14). Accordingly, the rotor blades 21*a* and 21*b* generate air currents.

Screw threads at both ends of the shaft 14 are formed to be in directions symmetrical with each other. With this configuration, inertial force occurring when the motor 10 stops is transmitted to the nuts 16*a* and 16*b* and loosening of the nuts 16*a* and 16*b* can be inhibited.

Figure 4A:
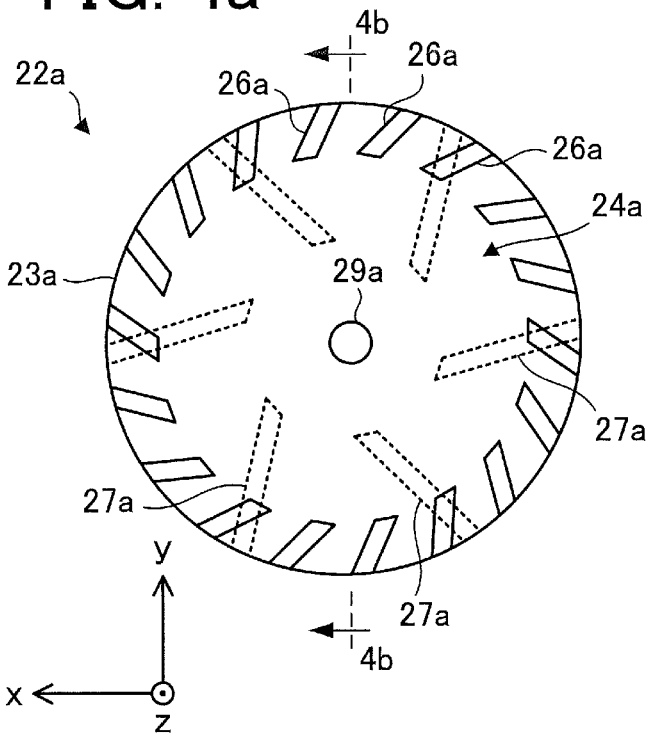
FIG. 4*a* is a plan view schematically showing a structure of a stator blade.

FIG. 4*a* is a plan view schematically showing a structure of the stator blade 22*a*.

Figure 4B:
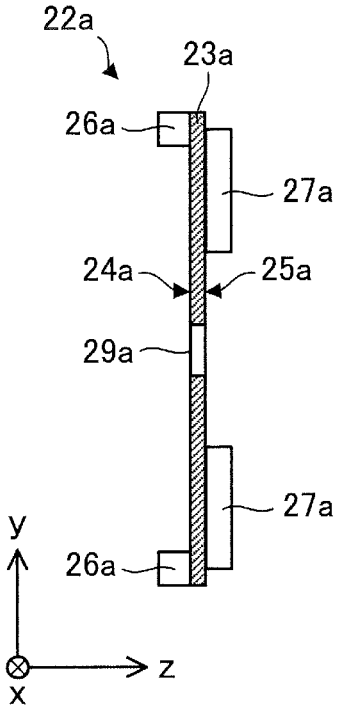
FIG. 4*b* is a cross-sectional view taken along a line 4*b*-4*b* in FIG. 4*a*.

FIG. 4*b* is a cross-sectional view taken along a line 4*b*-4*b* in FIG. 4*a*.

Figure 4C:
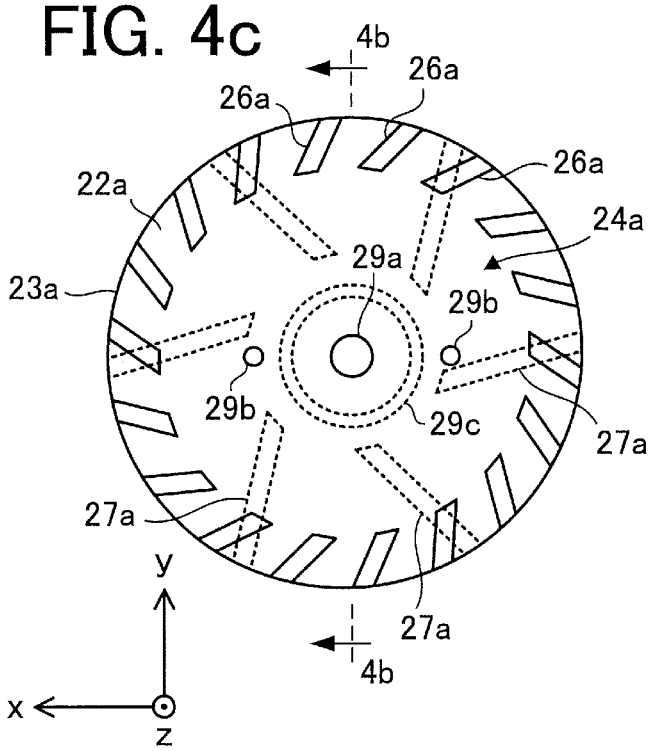
FIG. 4*c* is a plan view schematically showing another structure of the stator blade.

FIG. 4*c* is a plan view schematically showing another structure around the stator blade 22*a*.

Figure 4D:
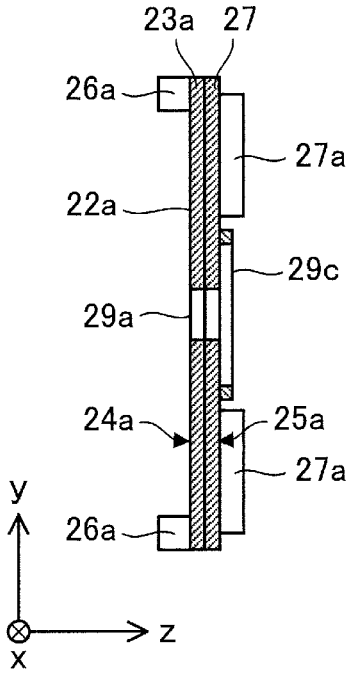
FIG. 4*d* is a cross-sectional view taken along a line 4*b*-4*b* in FIG. 4*c*.

FIG. 4*d* is a cross-sectional view taken along a line 4*b*-4*b* in FIG. 4*c*.

As shown in FIGS. 4*a* and 4*b*, the stator blade 22*a* includes a main plate 23*a*, at least one vane 26*a*, and a shaft hole 29*a* in which the shaft 14 is inserted. The stator blade 22*a* is provided to face the rotor blade 21*a*. In the example shown in FIG. 1, the stator blade 22*a* is fixed to the motor frame 11, while the stator blade 22*b* is fixed to the bracket 17. At least one wind guide plate 27*a* (first wind guide plate) is provided between the stator blade 22*a* and the motor 10.

The vane 26*a* regulates an air current generated by the rotation of the rotor blade 21*a* (e.g., direction of the air current). The wind guide plate 27*a* guides the air current generated by the rotation of the rotor blade 21*a* towards the motor 10.

The main plate 23*a* has a first surface 24*a* as a front side and a second surface 25*a* as a back side. The stator blade 22*a* is fixed to the casing 30 so that the first surface 24*a* faces the rotor blade 21*a*. That is, the first surface 24*a* faces the rotor blade 21*a* and the second surface 25*a* is a surface on the side opposite to the first surface 24*a*.

In this embodiment, a plurality of vanes 26*a* are formed on the first surface 24*a* and a plurality of wind guide plates 27*a* are formed on the second surface 25*a*. The plurality of vanes 26*a* and the plurality of wind guide plates 27*a* are arranged in spiral patterns to be in phases opposite to each other.

The structure shown in FIGS. 4*c* and 4*d* may be employed instead of the structure shown in FIGS. 4*a* and 4*b*. The electric blower having the structure shown in FIGS. 4*c* and 4*d* corresponds to the electric blower 1 shown in FIG. 2*b*. The stator blade 22*a* shown in FIGS. 4*c* and 4*d* includes at least one vane 26*a*, a shaft hole 29*a* in which the shaft 14 is inserted, and two fixation holes 29*b*. In the structure shown in FIGS. 4*c* and 4*d*, similarly to the structure shown in FIGS. 4*a* and 4*b*, at least one wind guide plate 27*a* (first wind guide plate) is provided between the stator blade 22*a* and the motor 10.

In the example shown in FIGS. 4*c* and 4*d*, the wind guide plate 27*a* is formed not on the main plate 23*a* of the stator blade 22*b* but on a main plate 27. A shaft hole 29*a*, two fixation holes 29*b*, and a frame insertion hole 29*c* in which an end of the motor frame 11 in the axial direction is inserted are formed in the main plate 27. The fixation holes 29*b* that are two through holes are formed in the main plate 23*a* and the main plate 27, and the main plate 23*a* and the main plate 27 can be fixed together by putting fixation members through the fixation holes 29*b*. However, it is also possible to fix the main plate 23*a* and the main plate 27 together by using an adhesive agent or the like without forming the fixation holes 29*b* in the main plate 23*a* and the main plate 27. By separately molding the main plate 23*a* provided with the vane 26*a* and the main plate 27 provided with the wind guide plate 27*a*, the structure of the mold is simplified and the molding is facilitated in comparison with the structure in which these parts are integrated together (i.e., the structure shown in FIGS. 4*a* and 4*b*).

The stator blade 22*b* includes a main plate 23*b* and at least one vane 26*b*. The stator blade 22*b* is provided to face the rotor blade 21*b*. In this embodiment, the stator blade 22*b* has no wind guide plate. In this embodiment, the stator blade 22*b* has the same structure as the stator blade 22*a* except for the wind guide plate. That is, the main plate 23*b* corresponds to the main plate 23*a* shown in FIGS. 4*a* and 4*b*, and the vane 26*b* corresponds to the vane 26*a* shown in FIGS. 4*a* and 4*b*.

The vane 26*b* regulates an air current generated by the rotation of the rotor blade 21*b* (e.g., direction of the air current).

The main plate 23*b* has a third surface 24*b* as a front side and a fourth surface 25*b* as a back side (FIG. 2*a*). The stator blade 22*b* is fixed to the casing 30 so that the third surface 24*b* faces the rotor blade 21*b*. That is, the third surface 24*b* faces the rotor blade 21*b* and the fourth surface 25*b* is a surface on the side opposite to the third surface 24*b*. In this embodiment, a plurality of vanes 26*b* are formed on the third surface 24*b*.

As shown in FIG. 4*a*, the stator blade 22*a* (specifically, the main plate 23*a*) is in a circular shape, and the plurality of vanes 26*a* are arranged in the circumferential direction of the stator blade 22*a* (specifically, the main plate 23*a*) and arranged in a radial pattern around the rotation center of the rotor blade 21*a*. On the stator blade 22*b*, the plurality of vanes 26*b* are arranged similarly to the plurality of vanes 26*a*.

As shown in FIG. 4*a*, the plurality of wind guide plates 27*a* are arranged in the circumferential direction of the stator blade 22*a* (specifically, the main plate 23*a*) and arranged in a radial pattern around the rotation center of the rotor blade 21*a*.

Figure 5:
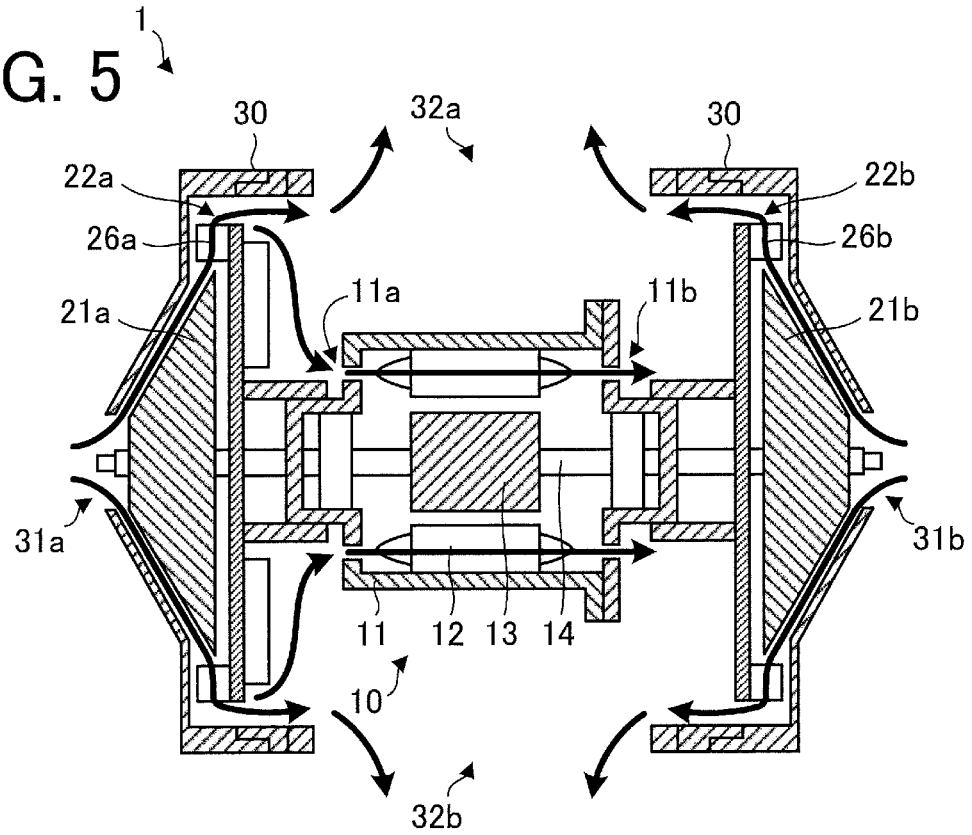
FIG. 5 is a diagram showing a flow of air in the electric blower when the electric blower is driven.
Figure 6:
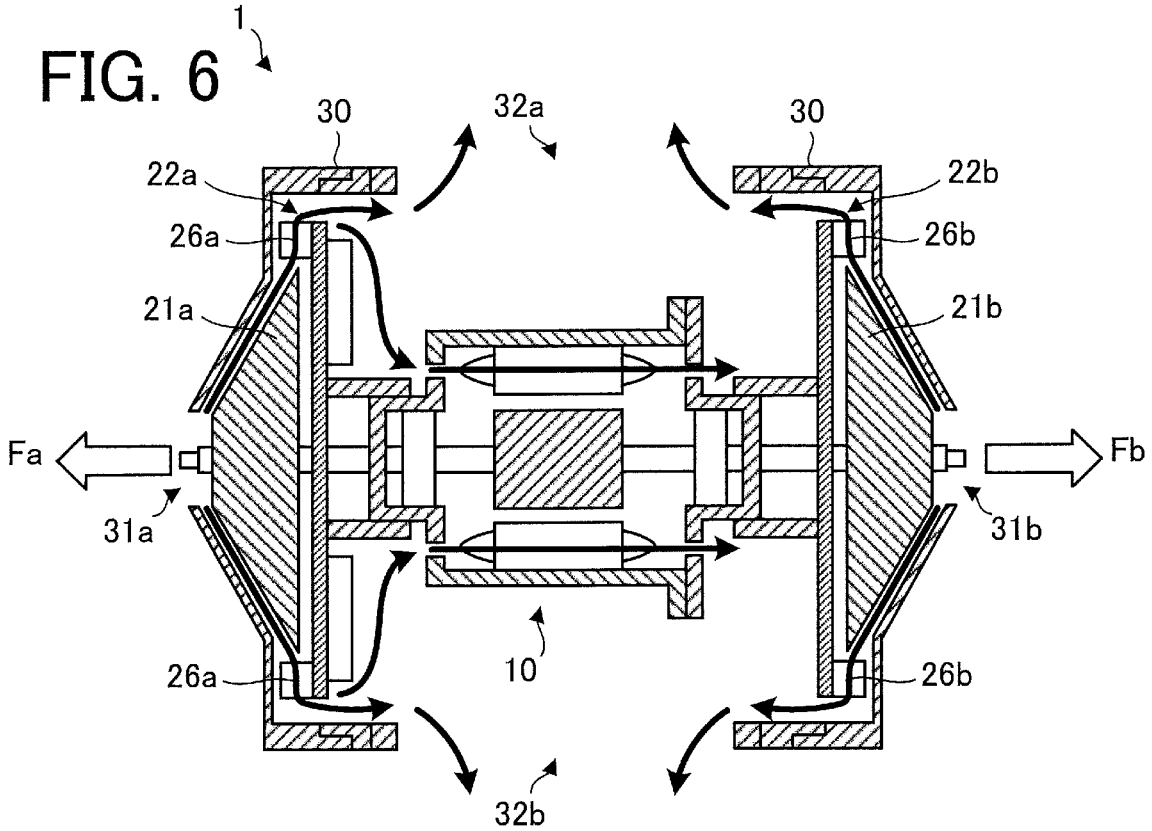
FIG. 6 is a diagram showing the flow of air in the electric blower when the electric blower is driven.

FIG. 5 and FIG. 6 are diagrams showing a flow of air in the electric blower 1 when the electric blower 1 is driven.

As shown in FIG. 5, while the motor 10 is driving, the rotor 13 and the shaft 14 rotate and the rotor blades 21*a* and 21*b* rotate. Accordingly, the rotor blades 21*a* and 21*b* generate air currents and air flows into the electric blower 1 (specifically, the casing 30) through the intakes 31*a* and 31*b*. The flow of air is regulated by the stator blades 22*a* and 22*b* and the air is discharged outside the electric blower 1 through the outlets 32*a* and 32*b*.

Since the holes 11*a* and 11*b* are formed in the motor frame 11, part of the air flows into the motor 10 (specifically, the motor frame 11). In the example shown in FIG. 5, air flows into the motor 10 through the holes 11*a*, passes through the inside of the stator 12 (outside of the rotor 13), and is discharged outside the motor 10 through the holes 11*b*.

As shown in FIG. 6, in regard to the rotor blade 21*a* side, when air flows into the electric blower 1 through the intake 31*a* while the motor 10 is driving, thrust force Fa occurs in the shaft 14 of the motor 10 and the rotor blade 21*a* due to pressure difference between the intake 31*a* side and the outlets 32*a*, 32*b* side.

Similarly, as shown in FIG. 6, in regard to the rotor blade 21*b* side, when air flows into the electric blower 1 through the intake 31*b* while the motor 10 is driving, thrust force Fb occurs in the shaft 14 of the motor 10 and the rotor blade 21*b* due to pressure difference between the intake 31*b* side and the outlets 32*a*, 32*b* side.

The direction of the thrust force Fa and the direction of the thrust force Fb are opposite to each other in the axial direction. Thus, since the thrust force Fa and the thrust force Fb cancel each other, the thrust load acting on the motor 10 (specifically, the bearings 15*a* and 15*b*) can be reduced.

Figure 7:
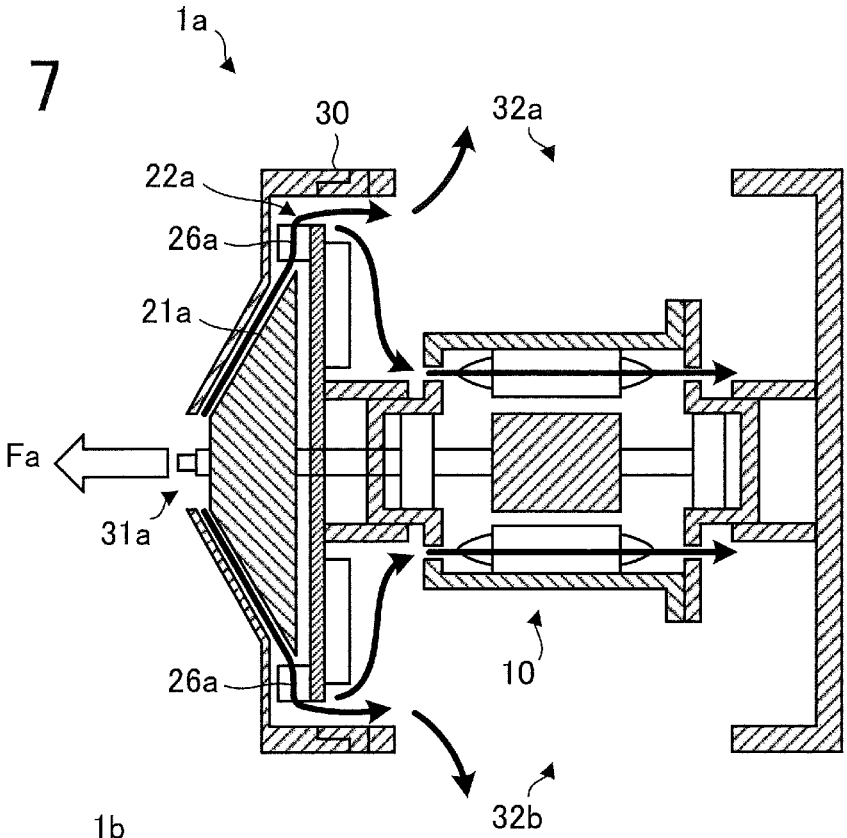
FIG. 7 is a cross-sectional view schematically showing a structure of an electric blower according to a comparative example.

FIG. 7 is a cross-sectional view schematically showing a structure of an electric blower 1*a* according to a comparative example. In the electric blower 1*a*, the rotor blade 21*a* is provided on one side in the axial direction.

In the electric blower 1*a*, when air flows into the electric blower 1*a* through the intake 31*a* while the motor 10 is driving, thrust force Fa occurs in the shaft 14 of the motor 10 and the rotor blade 21*a* due to pressure difference between the intake 31*a* side and the outlets 32*a*, 32*b* side. In this case, due to this thrust force Fa, a thrust load occurs in the bearing 15*a* and friction occurs between an inner ring and an outer ring of the bearing 15*a*. As a result, the friction increases with the increase in the revolution speed of the motor 10 (i.e., the revolution speed of the rotor blade 21*a*) and the operating life of the bearing 15*a* decreases.

In this embodiment, the electric blower 1 includes the rotor blades 21*a* and 21*b* and the directions of the thrust forces Fa and Fb are opposite to each other in the axial direction. Thus, since the thrust force Fa and the thrust force Fb cancel each other, the thrust load acting on the bearings 15*a* and 15*b* can be reduced. As a result, since the decrease in the operating life of the bearings 15*a* and 15*b* can be prevented, the decrease in the operating life of the electric blower 1 can be prevented.

Further, the electric blower 1 according to the first embodiment includes the wind guide plate 27*a*. The wind guide plate 27*a* guides part of the air current that passed between the main plate 23*a* of the stator blade 22*a* and the casing 30, and part (rotating component) of the air current is guided to an inside in a radial direction of the electric blower 1 (motor 10) (hereinafter referred to simply as a "radial direction") and flows into the motor 10 through the holes 11*a*. The air that flowed into the motor 10 is discharged outside the motor 10 through the holes 11*b*. Accordingly, heat radiation of the motor 10 can be carried out. Therefore, thanks to the wind guide plate 27*a*, the heat radiation of the motor 10 can be carried out efficiently and aerodynamic efficiency of the electric blower 1 can be increased.

Second Embodiment

Figure 8:
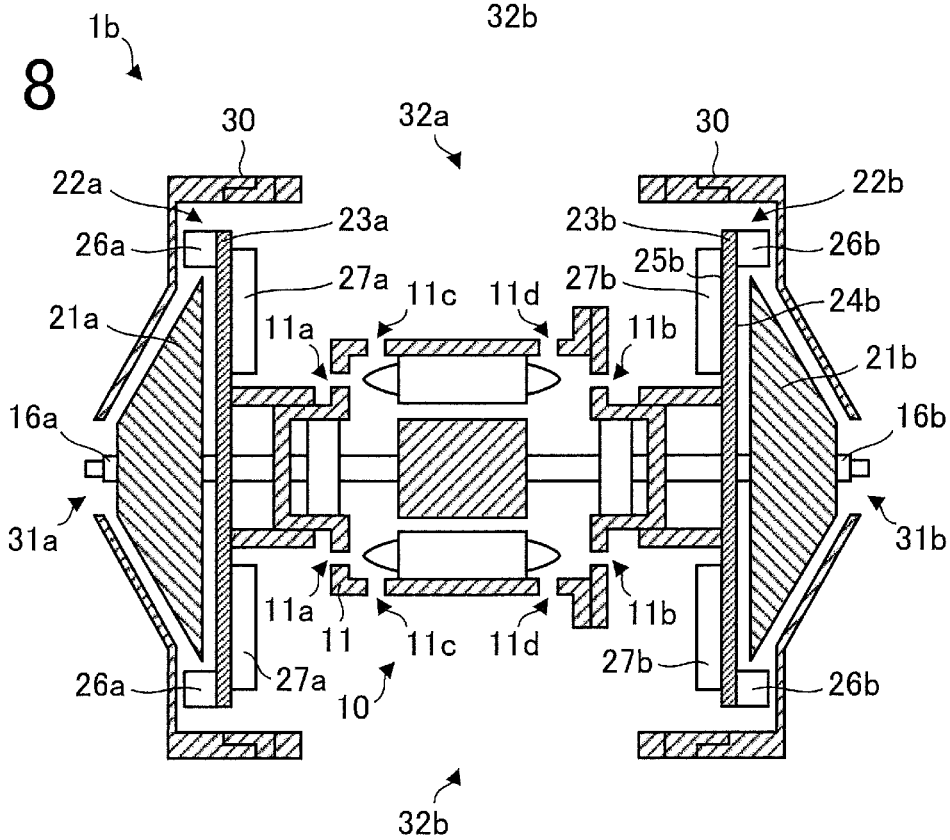
FIG. 8 is a cross-sectional view schematically showing a structure of an electric blower according to a second embodiment of the present invention.

FIG. 8 is a cross-sectional view schematically showing a structure of an electric blower 1*b* according to a second embodiment of the present invention.

In the electric blower 1*b* according to the second embodiment, the stator blade 22*b* includes a main plate 23*b* and at least one vane 26*b*. Further, the motor frame 11 of the motor 10 has holes (windholes) 11*c* and 11*d*. Furthermore, at least one wind guide plate 27*b* (second wind guide plate) is provided between the stator blade 22*b* and the motor 10.

That is, the electric blower 1*b* according to the second embodiment differs from the electric blower 1 according to the first embodiment in including the wind guide plate 27*b* and the holes 11*c* and 11*d*, and the rest of the structure and operation is the same as that of the electric blower 1 according to the first embodiment.

Specifically, a plurality of wind guide plates 27*b* are formed on the fourth surface 25*b*. The stator blade 22*b* has the same structure as the stator blade 22*a* shown in FIGS. 4*a* and 4*b*. Specifically, a plurality of vanes 26*b* and a plurality of wind guide plates 27*b* are arranged in spiral patterns to be in phases opposite to each other. Thus, similarly to the wind guide plates 27*a*, the wind guide plates 27*b* guide the air current generated by the rotation of the rotor blade 21*b* towards the motor 10. However, the structure around the stator blade 22*b* can be the structure shown in FIGS. 4*c* and 4*d* instead of the structure shown in FIGS. 4*a* and 4*b*.

In this embodiment, a plurality of holes 11*c* and a plurality of holes 11*d* are formed on both sides of the motor frame 11 in the radial direction. Each hole 11*c*, 11*d* passes through the motor frame 11 in the radial direction.

Figure 9:
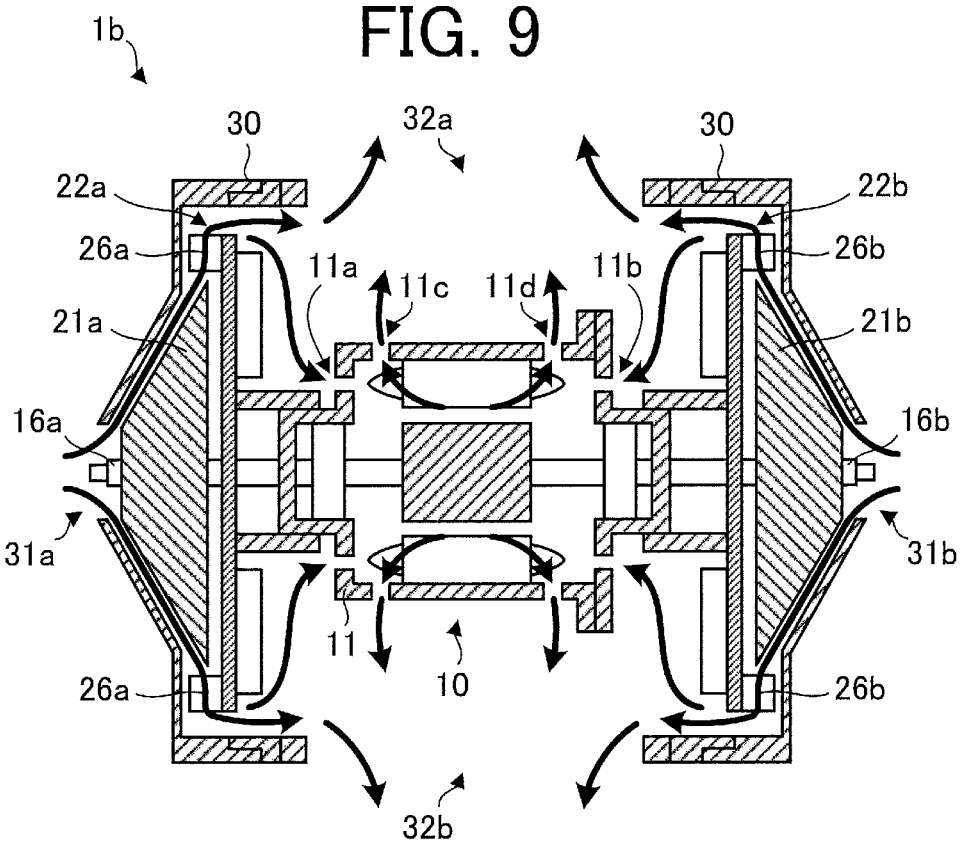
FIG. 9 is a diagram showing a flow of air in the electric blower when the electric blower is driven.

FIG. 9 is a diagram showing a flow of air in the electric blower 1*b* when the electric blower 1*b* is driven.

As shown in FIG. 9, while the motor 10 is driving, air flows into the electric blower 1*b* (specifically, the casing 30) through the intakes 31*a* and 31*b*. The flow of air is regulated by the stator blades 22*a* and 22*b* and the air is discharged outside the electric blower 1*b* through the outlets 32*a* and 32*b*.

In this embodiment, the electric blower 1*b* includes the wind guide plates 27*a* and 27*b*. The wind guide plates 27*a* guide part of the air current that passed between the main plate 23*a* of the stator blade 22*a* and the casing 30, and part (rotating component) of the air current is guided to the inside in the radial direction of the electric blower 1*b* (motor 10) and flows into the motor 10 through the holes 11*a*. Similarly to the wind guide plates 27*a*, the wind guide plates 27*b* guide part of the air current that passed between the main plate 23*b* of the stator blade 22*b* and the casing 30, and a part (rotating component) of the air current is guided to the inside in regard to the radial direction of the electric blower 1*b* (motor 10) and flows into the motor 10 through the holes 11*b*.

The air that flowed into the motor 10 is discharged outside the motor 10 through the holes 11*c* and 11*d* and discharged outside the electric blower 1*b* through the outlets 32*a* and 32*b*. Accordingly, the heat radiation of the motor 10 can be carried out. Therefore, thanks to the wind guide plates 27*a* and 27*b*, the heat radiation of the motor 10 can be carried out efficiently and the aerodynamic efficiency of the electric blower 1*b* can be increased.

Third Embodiment

Figure 10:
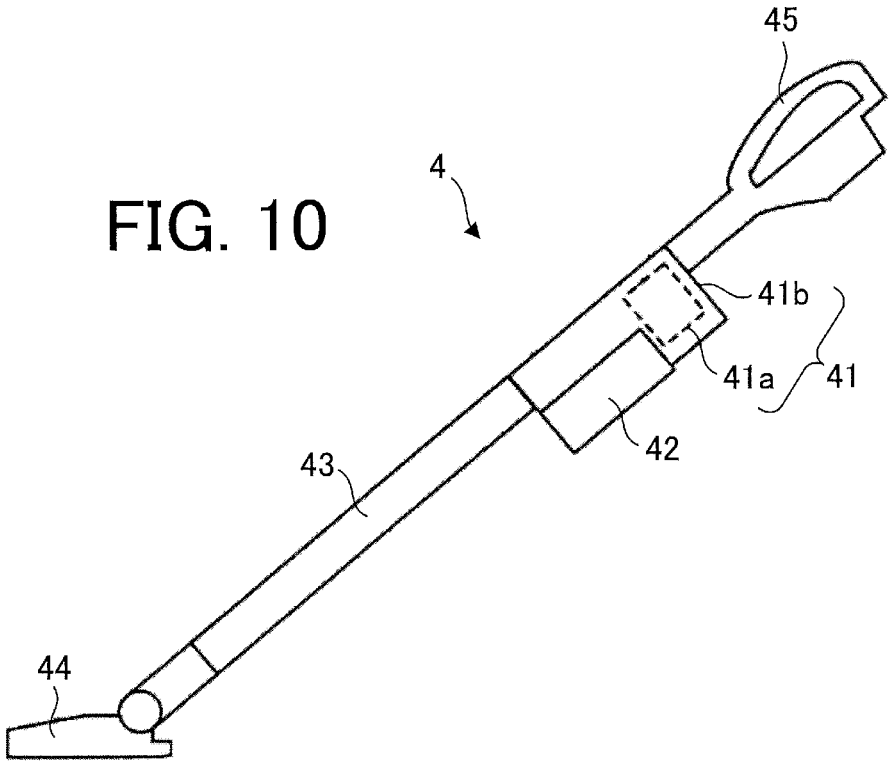
FIG. 10 is a side view schematically showing a vacuum cleaner according to a third embodiment of the present invention.

FIG. 10 is a side view schematically showing a vacuum cleaner 4 (also referred to simply as a "cleaner") according to a third embodiment of the present invention.

The vacuum cleaner 4 includes a main body 41, a dust collection part 42, a duct 43, a suction nozzle 44 and a grip part 45.

The main body 41 includes an exhaust port 41*b* and an electric blower 41*a* that generates suction power (suction wind) and sends dust to the dust collection part 42. The electric blower 41*a* is the electric blower 1 according to the first embodiment or the electric blower 1*b* according to the second embodiment.

The dust collection part 42 is attached to the main body 41. However, the dust collection part 42 may also be provided inside the main body 41. For example, the dust collection part 42 is a container including a filter for separating dust and air from each other. The suction nozzle 44 is attached to a tip end of the duct 43.

When the power of the vacuum cleaner 4 is turned on, electric power is supplied to the electric blower 41*a* and the electric blower 41*a* can be driven. While the electric blower 41*a* is driven, dust is sucked in through the suction nozzle 44 by the suction power generated by the electric blower 41*a*. The dust sucked in through the suction nozzle 44 passes through the duct 43 and is collected in the dust collection part 42. Air sucked in through the suction nozzle 44 passes through the electric blower 41*a* and is discharged outside the vacuum cleaner 4 through the exhaust port 41*b*.

The vacuum cleaner 4 according to the third embodiment includes one of the electric blowers described in the first and second embodiments (electric blower 1 or 1*b*), and thus has the same advantages as those described in the first or second embodiment.

Further, with the vacuum cleaner 4 according to the third embodiment, the decrease in the operating life of the electric blower 41*a* can be prevented, and consequently, the decrease in the operating life of the vacuum cleaner 4 can be prevented.

Furthermore, with the vacuum cleaner 4 according to the third embodiment, the aerodynamic efficiency of the electric blower 41*a* can be increased, and consequently, the aerodynamic efficiency of the vacuum cleaner 4 can be increased.

Fourth Embodiment

Figure 11:
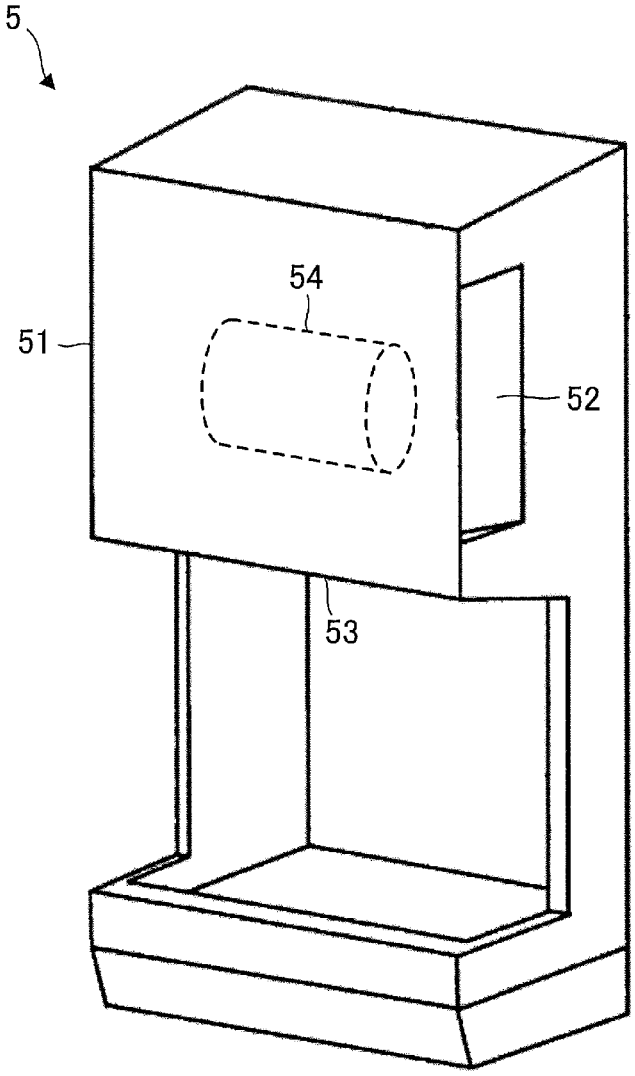
FIG. 11 is a perspective view schematically showing a hand drier as a hand drying device according to a fourth embodiment of the present invention.

FIG. 11 is a perspective view schematically showing a hand drier 5 as a hand drying device according to a fourth embodiment of the present invention.

The hand drier 5 as the hand drying device includes a casing 51 (referred to also as a "housing") and an electric blower 54. The casing 51 has an air intake 52 and an air outlet 53. The electric blower 54 is fixed inside the casing 51.

The electric blower 54 is the electric blower 1 according to the first embodiment or the electric blower 1*b* according to the second embodiment. The electric blower 54 performs suction and blowing of air by generating an air current. Specifically, the electric blower 54 sucks in air exterior to the casing 51 through the air intake 52 and sends the air outside the casing 51 through the air outlet 53.

When the power of the hand drier 5 is turned on, electric power is supplied to the electric blower 54 and the electric blower 54 can be driven. While the electric blower 54 is driven, air exterior to the hand drier 5 is sucked in through the air intake 52. The air sucked in through the air intake 52 passes through the inside of the electric blower 54 and is discharged through the air outlet 53. By placing hands close to the air outlet 53, the user of the hand drier 5 can blow off waterdrops adhering to the hands and dry the hands.

The hand drier 5 according to the fourth embodiment includes one of the electric blowers described in the first and second embodiments (electric blower 1 or 1*b*), and thus has the same advantages as those described in the first or second embodiment.

Further, with the hand drier 5 according to the fourth embodiment, the decrease in the operating life of the electric blower 54 can be prevented, and consequently, the decrease in the operating life of the hand drier 5 can be prevented.

Furthermore, with the hand drier 5 according to the fourth embodiment, the aerodynamic efficiency of the electric blower 54 can be increased, and consequently, the aerodynamic efficiency of the hand drier 5 can be increased.

Features in the embodiments described above can be appropriately combined with each other.

What is claimed is:

1. An electric blower comprising:

a motor;

a first rotor blade provided on one end side of the motor in an axial direction;

a second rotor blade provided on another side of the motor opposite to the first rotor blade in the axial direction;

a casing covering the first rotor blade and the second rotor blade and including a first radial outlet formed to face the motor and a second radial outlet formed to face the motor;

a first stator blade provided to face the first rotor blade; and a second stator blade provided to face the second rotor blade, wherein the first stator blade includes:

a first main plate having a first surface and a second surface that is a surface on a side opposite to the first surface; and a plurality of vanes formed on the first surface and arranged to regulate an air current generated by rotation of the first rotor blade, wherein the plurality of vanes are arranged in a radial pattern around a rotation center of the first rotor blade, wherein the first rotor blade is a first mixed flow fan, and the second rotor blade is a second mixed flow fan, wherein the first radial outlet and the second radial outlet are separated from each other by the motor and a motor frame surrounding the motor.

2. The electric blower according to claim 1, further comprising a first wind guide plate provided between the first stator blade and the motor and to guide the air current towards the motor.

3. The electric blower according to claim 1, wherein the second stator blade includes:

a second main plate having a third surface and a fourth surface that is a surface on a side opposite to the third surface; and a vane formed on the third surface and arranged to regulate an air current generated by rotation of the second rotor blade.

4. The electric blower according to claim 3, further comprising a second wind guide plate provided between the second stator blade and the motor and to guide the air current generated by the rotation of the second rotor blade towards the motor.

5. The electric blower according to claim 1, wherein the motor includes:

a rotor; and a shaft fixed to the rotor and able to rotate the first rotor blade and the second rotor blade.

6. The electric blower according to claim 5, wherein the motor frame covers the rotor, and the motor frame has holes formed on both sides in the axial direction, the holes passing through the motor frame in the axial direction.

7. The electric blower according to claim 6, wherein the motor frame has windholes formed on both sides of the motor in a radial direction, the windholes passing through the motor frame in the radial direction.

8. The electric blower according to claim 1, wherein the casing has:

a first intake formed to face the first rotor blade; and a second intake formed to face the second rotor blade.

9. The electric blower according to claim 1, wherein the casing comprises:

a first fan cover and a second fan cover separated and spaced apart from each other by the first radial outlet and the second radial outlet and provided on sides of the motor opposite in the axial direction, the first fan cover covering the first rotor blade and the second fan cover covering the second rotor blade.

10. A vacuum cleaner comprising:

a dust collection part; and an electric blower to generate suction power and send dust to the dust collection part, wherein the electric blower includes:

a motor;

a first rotor blade provided on one end side of the motor in an axial direction;

a second rotor blade provided on another side of the motor opposite to the first rotor blade in the axial direction;

a casing covering the first rotor blade and the second rotor blade and including a first radial outlet formed to face the motor and a second radial outlet formed to face the motor;

a first stator blade provided to face the first rotor blade; and a second stator blade provided to face the second rotor blade, wherein the first stator blade includes:

a first main plate having a first surface and a second surface that is a surface on a side opposite to the first surface; and a plurality of vanes formed on the first surface and arranged to regulate an air current generated by rotation of the first rotor blade, wherein the plurality of vanes are arranged in a radial pattern around a rotation center of the first rotor blade, wherein the first rotor blade is a first mixed flow fan, and the second rotor blade is a second mixed flow fan, wherein the first radial outlet and the second radial outlet are separated from each other by the motor and a motor frame surrounding the motor.

11. The vacuum cleaner according to claim 10, further comprising a first wind guide plate provided between the first stator blade and the motor and to guide the air current towards the motor.

12. The vacuum cleaner according to claim 10, wherein the second stator blade includes:

a second main plate having a third surface and a fourth surface that is a surface on a side opposite to the third surface; and a vane formed on the third surface and to regulate an air current generated by rotation of the second rotor blade.

13. The vacuum cleaner according to claim 12, further comprising a second wind guide plate provided between the second stator blade and the motor and to guide the air current generated by the rotation of the second rotor blade towards the motor.

14. The vacuum cleaner according to claim 10, wherein the motor includes:

a rotor; and a shaft fixed to the rotor and able to rotate the first rotor blade and the second rotor blade.

15. The vacuum cleaner according to claim 10, wherein the casing comprises:

a first fan cover and a second fan cover separated and spaced apart from each other by the first radial outlet and the second radial outlet and provided on sides of the motor opposite in the axial direction, the first fan cover covering the first rotor blade and the second fan cover covering the second rotor blade.

* * * * *